United States Patent [19]

Senter

[11] 4,261,072

[45] Apr. 14, 1981

[54] METHOD FOR PROVIDING A STITCHED FOXING TAPE ON AN ARTICLE OF FOOTWEAR

[75] Inventor: Jonas Senter, New York, N.Y.

[73] Assignee: CITC Industries, Inc., New York, N.Y.

[21] Appl. No.: 912,105

[22] Filed: Jun. 2, 1978

[51] Int. Cl.[3] ..... A43D 9/00; A43B 13/18

[52] U.S. Cl. ..... 12/142 D; 36/17 PW

[58] Field of Search ..... 12/142 D, 146 W, 142 MC; 36/14, 17 R, 17 A, 17 PW, 11

[56] References Cited

U.S. PATENT DOCUMENTS

| | | | |
|---|---|---|---|
| 3,135,060 | 6/1964 | McConnell | 36/11 |
| 3,217,345 | 11/1965 | Snitzer | 36/14 |
| 3,739,502 | 6/1973 | Auberry | 12/142 D |
| 4,122,574 | 10/1978 | Karalis | 36/14 |

*Primary Examiner*—Patrick D. Lawson

[57] ABSTRACT

A method and apparatus for manufacturing an article of footwear in which an upper and a sole meet at a juncture which is covered by a foxing tape applied to the upper and sole. The foxing tape is constituted of a curable elastomeric material and is applied to the upper and sole in partially cured condition. Stitches of material are formed in the foxing tape along the length thereof when the foxing tape is partially cured and thereafter the foxing tape is fully cured with the stitches in place.

7 Claims, 3 Drawing Figures

METHOD FOR PROVIDING A STITCHED FOXING TAPE ON AN ARTICLE OF FOOTWEAR

FIELD OF THE INVENTION

The invention is directed to the method of manufacture of an article of footwear and particular to a foxing tape with stitches therein.

PRIOR ART

It is known in the art to form stitches between the upper and a flange or lip of the sole. Indeed moccasins are formed in this way. The stitched material passes through the upper and the sole or lip.

U.S. Pat. No. 1,600,620 shows such a method of shoe construction and therein is disclosed a shoe having a sole 10 which is provided with a lip 11 and a channel 12. The lip 11 is braided to the upper 18 by means of braid of stiff material 16.

U.S. Pat. No. Des. 167,008 to Spilman shows a mocassin which includes a decorative stitching positioned between the sole and the upper.

U.S. Pat. No. Des. 178,654 to Freedman also shows such a construction.

Other patents related to this attachment of the flange or lip to the upper by means of stitching is found in the following patents.

U.S. Pat. No. 1,947,288 to Daniels
U.S. Pat. No. 2,946,069 to Bozza
U.S. Pat. No. 2,040,459 to Bagshaw
U.S. Pat. No. 2,738,527 to Weiss

SUMMARY OF THE INVENTION

An object of the invention is to provide the appearance of decorative stitching in an article of footwear without need for piercing the upper. By avoiding this operation the upper remains intact and is not weakened by the holes formed during the stitching operation.

In accordance with the invention a foxing tape of curable elastomeric material is applied to an upper and a sole to cover the juncture thereof. The foxing tape is applied in partially cured state and stitches of material are formed in the foxing tape along the length thereof. After the foxing tape has been applied to the upper and sole it is completely cured in place.

Thereby, the appearance of decorative stitching is formed on the article without the stitches actually penetrating through the upper or sole.

The stitching is, in accordance with the invention, formed by loops to provide a stitch portion which extends along the upper edge of the foxing tape and spaced portions extending normal to said upper edge in spaced relation along the foxing tape.

DETAILED DESCRIPTION

Figure 1:
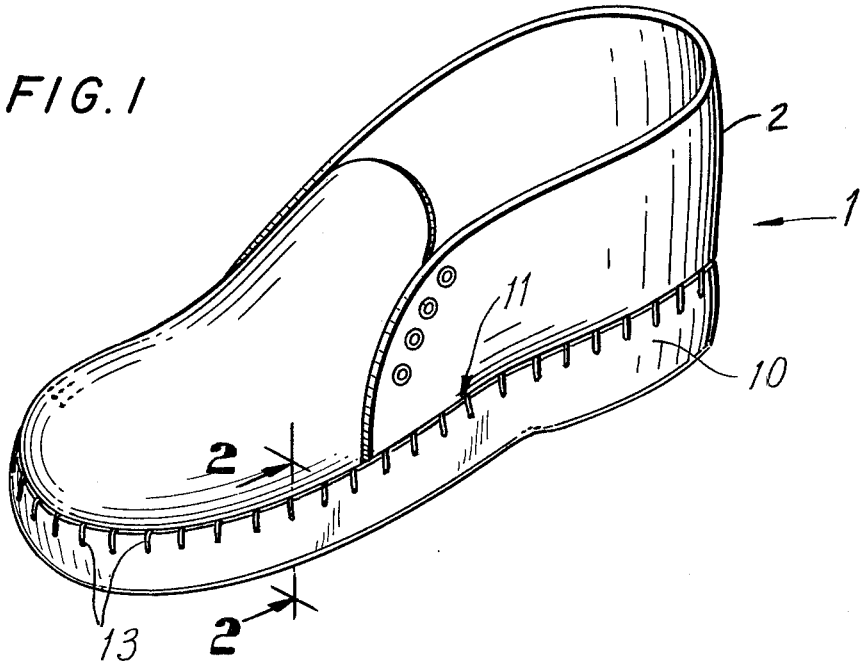
FIG. 1 is a perspective view of an article of footwear having the construction according to the invention.
Figure 2:
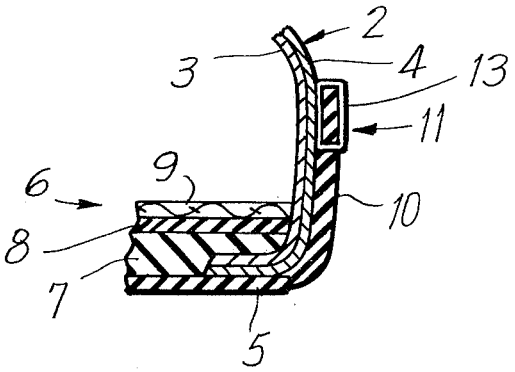
FIG. 2 is a sectional view on enlarged scale taken along lines 2—2 in FIG. 1.
Figure 3:
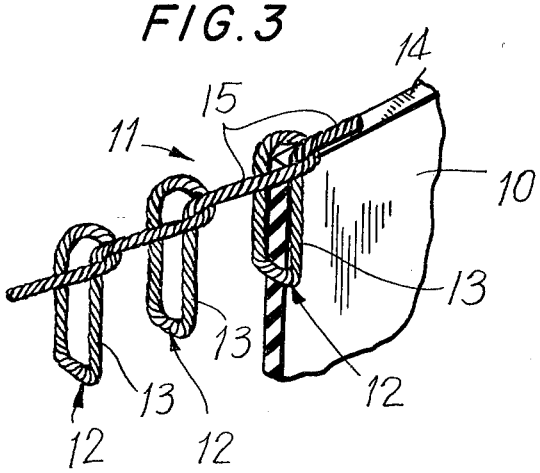
FIG. 3 is an enlarged view showing the stitching formation in the foxing tape for the footwear article of the invention.

FIG. 1 shows an article of footwear which can be a sneaker or shoe of any conventional type. The particular illustration of the article is of no significance and the features of the invention will be evident hereafter.

The article 1 is formed with an upper 2 having inner and outer layers 3 and 4 respectively. The upper is of conventional construction and requires no elaboration as regards its material or construction.

The article 1 further comprises a sole 5 which can be constituted of elastomeric material although this is not essential to the invention.

The upper 2 is sandwiched between the sole 5 and an inner sole 6, the latter being of conventional construction and employing resilient layers 7 and 8 with a cover layer 9 of cloth or similar material. The construction of the inner sole forms no part of the invention and may depart from that which has been shown.

The article further comprises a foxing tape 10 which is attached to the upper 2 and the sole 5 and forms the lower lateral edge of the article. The use of such foxing tape is conventional, particularly, with sneakers and articles of footwear of this type.

It is contemplated by the invention that a decorative stitching be formed at the upper edge of the foxing tape to simulate a mocassin-type construction.

The decorative stitching is shown at 11 and is formed by loops 12 which pass through the upper portion of the foxing tape.

The loops comprise front parts 13 which are visible at the upper edge of the foxing tape and which extend perpendicularly to the upper edge 14 of the foxing tape. The stitching material comprises length 15 between loops 12 which extend along the upper edge 14 of the foxing tape. In this way the upper edge of the foxing tape is substantially completely covered by the stitching material.

The foxing tape 10 is made of elastomeric material of conventional type which is applied to the upper and sole in the following novel fashion.

The elastomer is partially cured so that it can be handled and is shape retentive and the stitching 11 is formed at an edge portion of the foxing tape. The foxing tape with the stitches is then applied to the upper and sole with a bondable adhesive until the foxing tape has been completely installed around the entire periphery of the article. The foxing tape is then completely cured in place to form a permanent bond with the sole 5 and the upper 2. Thereby, the decorative stitching will be affixed to the article with the foxing tape and will simulate the appearance of stitching which attaches the foxing tape to the upper. However, the stitches do not pierce the upper and thereby weaken the latter.

Furthermore, the presence of the stitches in the upper portion of the foxing tape enhances the handleability thereof and furnished reinforcement for the foxing tape in its partially cured condition.

It is not necessary for the foxing tape to be completely constituted of the curable elastomeric material and by way of example, a composite can be formed consisting of an inner layer of elastomeric material and an outer fabric layer bonded to the inner layer. The stitches are passed through both layers of the foxing tape and bonding will be effected between the elastomeric material and the upper and sole.

The front portions 13 of the loops 12 are preferably of a length between $\frac{1}{3}$ and $\frac{1}{2}$ the height of the foxing tape to satisfy the decorative and functional attributes thereof. In certain circumstances, however, it may be permissible to deviate from this range.

Although the invention has been described in conjunction with a specific embodiment thereof, numerous modifications and variations will become apparent to those skilled in the art which will not depart from the scope and spirit of the invention as defined in the attached claims.

What is claimed is:

1. A method of manufacturing an article of footwear comprising forming an upper and a sole of an article of footwear which meet at a juncture, applying a foxing tape to said upper and sole proximate said juncture, said foxing tape being constituted of a curable elastomeric material, applying stitches of a material through said foxing tape along the length thereof without piercing the upper with said stitches, said foxing tape being in partially cured condition, applying the partially cured foxing tape with the stitches thereon to the upper and sole and completing the curing of the foxing tape.

2. A method as claimed in claim 1 wherein said foxing tape has an upper portion adjacent the upper, said stitches passing through said foxing tape in said upper portion.

3. A method as claimed in claim 2 wherein said foxing tape has an upper edge, said stitches extending normal to said edge in spaced relation along said foxing tape and along said upper edge.

4. A method as claimed in claim 3 wherein said stitches extending normal to said upper edge have a length of between $\frac{1}{3}$ and $\frac{1}{2}$ the height of the foxing tape.

5. A method as claimed in claim 3 wherein said foxing tape extends around the entire periphery of the article of footwear.

6. A method as claimed in claim 3 wherein said stitches extending normal to the upper edge are uniformly spaced along the length of the foxing tape.

7. A method as claimed in claim 3 wherein said stitches extending along said upper edge cover said edge and lie at the juncture between said edge and the upper.

* * * * *